US008806776B2

(12) United States Patent
Leick et al.

(10) Patent No.: US 8,806,776 B2
(45) Date of Patent: Aug. 19, 2014

(54) FOOTWEAR WHICH IMPROVES FOOT SUPPORT

(75) Inventors: Patrick Leick, Villaz (FR); Delphine Madelaine, Annecy (FR); Gérald Delgorgue, Ruffieux (FR); Sylvain Richard, Marcellaz Albanais (FR)

(73) Assignee: Salomon S.A.S., Metz-Tessy (FR)

( * ) Notice: Subject to any disclaimer, the term of this patent is extended or adjusted under 35 U.S.C. 154(b) by 706 days.

(21) Appl. No.: 13/001,350

(22) PCT Filed: Jun. 26, 2009

(86) PCT No.: PCT/FR2009/000797

§ 371 (c)(1),
(2), (4) Date: Dec. 23, 2010

(87) PCT Pub. No.: WO2009/156625

PCT Pub. Date: Dec. 30, 2009

(65) Prior Publication Data

US 2011/0113648 A1 May 19, 2011

(30) Foreign Application Priority Data

Jun. 27, 2008 (FR) ..... 08 03641

(51) Int. Cl.
*A43C 11/00* (2006.01)

(52) U.S. Cl.
USPC ..... 36/50.1; 36/45; 12/142 LC

(58) Field of Classification Search
USPC ..... 36/50.1, 45; D2/972; 12/142 LC
See application file for complete search history.

(56) References Cited

U.S. PATENT DOCUMENTS

| | | | | | |
|---|---|---|---|---|---|
| 4,447,967 | A | | 5/1984 | Zaino | |
| 4,642,914 | A | * | 2/1987 | Caldeira | 36/50.1 |
| 4,766,681 | A | * | 8/1988 | O'Rourke et al. | 36/89 |
| 5,271,130 | A | | 12/1993 | Batra | |
| 5,566,474 | A | | 10/1996 | Leick et al. | |
| 5,692,319 | A | | 12/1997 | Parker et al. | |
| 6,029,376 | A | | 2/2000 | Cass | |
| D479,392 | S | * | 9/2003 | Hillyer | D2/972 |
| D511,883 | S | * | 11/2005 | Matis | D2/969 |
| D515,800 | S | * | 2/2006 | Bertholon | D2/972 |
| D538,019 | S | * | 3/2007 | Schoenborn et al. | D2/969 |
| D545,546 | S | * | 7/2007 | Schoenborn et al. | D2/969 |
| D580,155 | S | * | 11/2008 | Banik | D2/969 |
| D680,728 | S | * | 4/2013 | Stryjak | D2/972 |

FOREIGN PATENT DOCUMENTS

FR 2 856 558 A1 12/2004

* cited by examiner

*Primary Examiner* — Ted Kavanaugh
(74) *Attorney, Agent, or Firm* — Greenblum & Bernstein, P.L.C.

(57) ABSTRACT

An article of footwear including a sole, an upper, and a device for reversibly tightening the upper, the upper including an envelope and a reinforcement which at least partially covers the envelope, the reinforcement including at least one lateral branch and at least one medial branch, each branch extending transversely from a proximal end located by at the sole to a distal end, the tightening device including at least one lateral linking point and at least one medial linking point, each secured to the upper, and a mechanism for biasing the connection points in a direction to reversible tighten the upper. The envelope is flexible, at least one connection point is located on a branch of the reinforcement, and at least one branch is adhesively bonded to the envelope for at least part of its length.

20 Claims, 4 Drawing Sheets

FOOTWEAR WHICH IMPROVES FOOT SUPPORT

BACKGROUND

1. Field of the Invention

The invention relates to an article of footwear, in particular a sports shoe, and more particularly a shoe adapted for athletics, sport walking, or cycling. Footwear according to the invention can have a high upper or low upper.

2. Description of Background and Other Information

Footwear of the aforementioned type can be used in fields such as walking, running on flat or mountainous terrain, on-road and off-road cycling, roller skating, snowboarding, ball-playing sports, or the like, whether having a high upper or low upper and whether referred to as a boot or a shoe. In the following description, the use of the terms footwear, boot, and shoe are to be considered interchangeable and not to be construed as limiting, one relative to the other, unless stated otherwise.

It is always desirable for the shoe to be lightweight, whether it has a low upper or a high upper. Indeed, walking, racing or pedaling movements induce accelerations and decelerations of each foot. The lightness reduces the inertia of the shoe and, consequently, there is less fatigue from using the shoe.

It is also desirable for the foot to be well supported in the shoe, i.e., with little or no clearance. This is true for walking or running shoes, because supports must be firm. This is also true in cycling, in particular during pulling motions of the leg. Indeed, at the time when a tensile force is exerted, the foot tends to move away from the sole. This undesired movement reduces pedaling efficiency.

It is also desirable that the shoe protect the foot so that no or very few injuries occur, even during an intensive and/or prolonged sporting use.

In addition it is advantageous to provide the shoe with an attractive appearance, which promotes sales, for example. But the problem is to improve the aesthetics without penalizing the technical characteristics.

The prior art has proposed shoes that seek to optimize the aforementioned characteristics. However, it has not been possible to optimize all of them, at least simultaneously. For example, shoes specifically adapted to run a marathon can be used for only one race, because they are too fragile.

For example, a shoe that is too light becomes fragile. Conversely, a stronger shoe tends to be too heavy and not very flexible, as it is made of thicker or more rigid materials, which negatively affects foot support. Consequently, the efficiency of a stride or of a pedaling movement is reduced. Moreover, injuries can occur during intensive use.

SUMMARY

In view of the above, the invention in particular provides a lighter article of footwear, or a boot or a shoe (hereinafter "shoe," for convenience), without making it fragile.

The invention also optimizes foot support, i.e., to prevent undesirable movements of the foot inside the shoe.

The invention also protects the foot from injuries.

The invention further obtains an attractive appearance for the shoe, without affecting its technical properties.

More generally, the invention simultaneously optimizes the characteristics enumerated hereinabove and reconciles the conflicting requirements which they imply.

To this end, the invention is directed to an article of footwear, or shoe, including a sole, an upper, and a device for reversibly tightening the upper (i.e., for selectively tightening and loosening the upper relative to the wearer's foot), the upper including an envelope and a reinforcement which at least partially covers the envelope, the reinforcement including at least one lateral branch and at least one medial branch, each branch extending transversely from a proximal end located in the area of the sole to a distal end, the tightening device including at least one lateral connection point and at least one medial connection point, each secured to the upper, as well as means for biasing the connection points in a direction of reversible tightening of the upper.

The envelope is flexible, having at least one connection point located on a branch of the reinforcement, and having at least one branch adhesively bonded to the envelope over at least a portion of its length.

Because it is flexible, the envelope is lightweight. In addition, each reinforcing branch, through which the forces tightening the upper pass, carries a connection point of the tightening device. This makes it possible to bias the branches without biasing the envelope, or while biasing it at least slightly, when the upper is being tightened.

Finally, because the branches are adhesively bonded to the envelope, they place the upper and the foot in close contact. Moreover, the adhesive used for bonding the branch(es) on the envelope contributes to stiffening and reinforcing the upper. Therefore, the structure of the upper makes the shoe lighter and more capable of supporting the foot. Moreover, the appearance is improved, because it is more aesthetically appealing to affix the branches on the envelope with an adhesive than with stitches.

The resulting advantages include less fatigue for the user, increased efficiency, in particular when applying or receiving foot support forces while walking or when pushing and/or pulling while pedaling, greater foot protection in the case of intensive use of the shoe, and also an attractive visual aspect.

BRIEF DESCRIPTION OF THE DRAWINGS

Other characteristics and advantages of the invention will be better understood from the description that follows, with reference to the annexed drawings illustrating, by way of non-limiting embodiments, how the invention can be embodied, and in which.

DETAILED DESCRIPTION

The first embodiment, which is described hereinafter, relates more particularly to articles of footwear, hereinafter shoes, for walking or running on flat or uneven ground. However, the invention applies to other fields such as those mentioned hereinabove.

The first embodiment is described hereinafter with reference to FIGS. 1 to 4.

Figure 1:
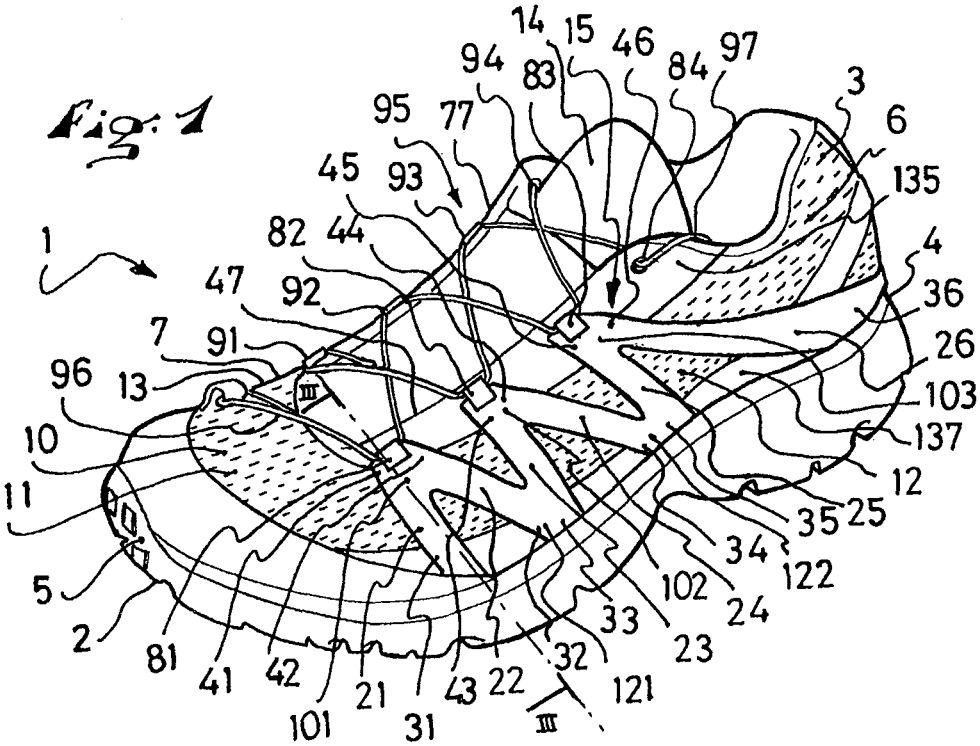
FIG. 1 is a perspective front view, lateral side, of a shoe according to the first embodiment of the invention.
Figure 2:
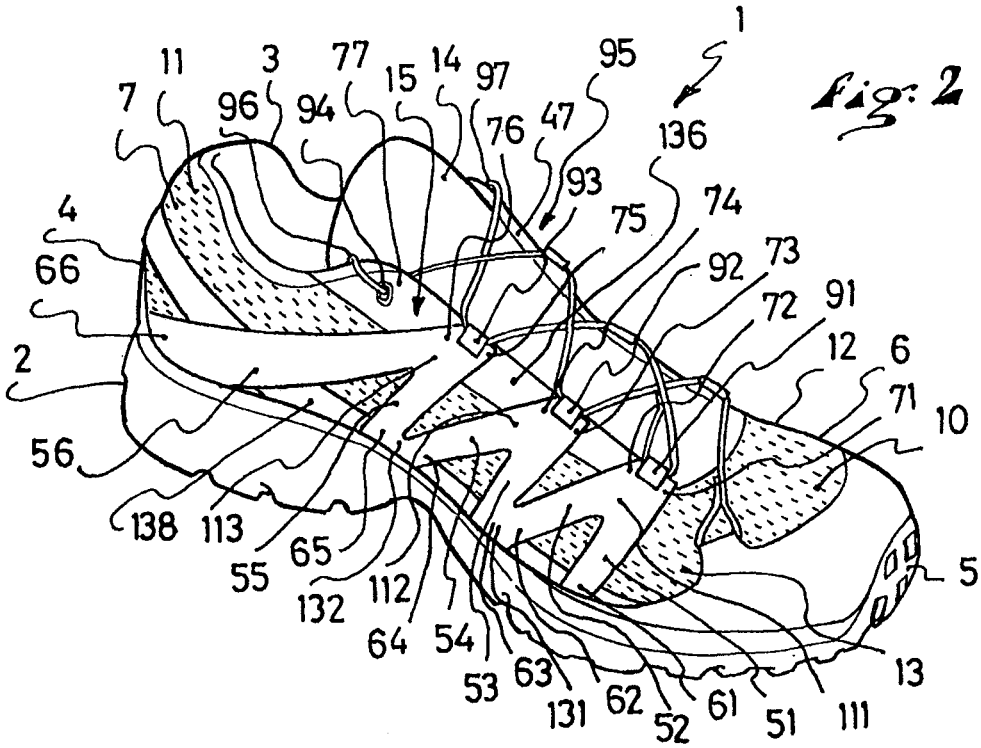
FIG. 2 is a perspective front view, medial side, of the shoe according to the first embodiment.

As shown in FIGS. 1 and 2, a running shoe 1 is adapted to receive the foot of the wearer, or user.

In a known fashion, the shoe 1 includes an outsole 2 and an upper 3. The shoe 1 extends lengthwise between a rear end or heel 4 and a front end or tip 5, and widthwise between a lateral side 6 and a medial side 7.

As shown, the upper 3 includes a lower portion 10 adapted to surround the foot, and has no upper portion. However, the upper could also be provided to also include an upper portion.

The shoe 1 is structured to enable good foot rolling movement when walking, transmission of sensory information, and impulses for supports or landings, during use of the shoe. For this reason, the sole 2 and the upper 3 are flexible.

The upper 3 includes an envelope 11 made out of a flexible material, which extends from the heel 4 to the front end 5, via the lateral side 6 and medial side 7. The envelope 11 is structured to closely conform to the foot of the user and to be compatible. Thus, the envelope 11 includes, for example, a knitted fabric, an a-jour fabric, the fibers of the fabric including, for example, synthetic materials such as polyurethane, natural materials such as cotton, or any combination of these materials. The fabric can be multilayered, depending upon the type of material or the comfort desired.

The envelope 11 includes a lateral quarter 12 and a medial quarter 13. The upper 3 further includes a tongue 14, which connects the quarters 12, 13 to one another. However, a tongue can be omitted. In such a case, the quarters 12, 13 can remain separate or they can be superimposed, i.e., overlapped.

The upper 3 also includes a reinforcement 15 that covers the envelope 11. According to the first embodiment, and in a non-limiting fashion, the reinforcement 15 includes a plurality of lateral branches 21 to 26 in a zigzag arrangement, which cover the envelope on the lateral side 6. For example, six lateral branches are provided, including a first 21, second 22, third 23, fourth 24, fifth 25, and sixth 26. The branches 21 to 26 are orderly arranged from the front 5 to the rear 4. Consequently, the first branch 21 is the farthest forward, and the sixth branch 26 is the farthest rearward. This convention makes it easier to understand the invention, as will be seen hereinafter.

The lateral branches 21 to 26 each have a proximal end 31 to 36 and a distal end 41 to 46, respectively. Each proximal end 31 to 36 is located in the area of the sole 2, and each distal end 41 to 46 is spaced apart from the sole. In this case, the distal ends 41 to 46 are arranged in the area of an upper edge 47 of the lateral quarter 12. Of course, the branches 21 to 26 each extend from their proximal end to their distal end.

In the same spirit, the reinforcement 15 includes a plurality of medial branches 51 to 56 in zigzag arrangement, which cover the envelope on the medial side 7. For example, six medial branches are provided, including a first 51, second 52, third 53, fourth 54, fifth 55, and sixth 56. The branches 51 to 56 are orderly arranged from the front 5 to the rear 4. Consequently, the first branch 51 is the farthest forward, and the sixth branch 56 is the farthest in the rearward. This convention makes it easier to understand the invention, as will be seen hereinafter. The medial branches 51 to 56 each have a proximal end 61 to 66 and a distal end 71 to 76, respectively. Each proximal end 61 to 66 is located in the area of the sole 2, and each distal end 71 to 76 is spaced apart from the sole. In this case, the distal ends 71 to 76 are arranged in the area of an upper edge 77 of the medial quarter 13. Here again, the branches 51 to 56 each extend from their proximal end to their distal end.

The shoe 1 includes a tightening device 95 for reversibly tightening the upper 3, i.e., for selectively tightening and loosening the upper relative to the wearer's foot. According to the first embodiment, the tightening device includes a plurality of lateral connection points 81 to 84 and a plurality of medial connection points 91 to 94, each secured to the upper 3, as explained hereinafter. The lateral 81 to 94 and medial 91 to 94 connection points are orderly arranged from the front 5 to the rear 4, respectively. According to the first embodiment, the connection points 81 to 84, 91 to 94 are comprised of keepers designated by the same reference numerals, respectively. These keepers are fixed to the upper and to the reinforcement by stitching. They could also be fixed by an adhesive. The tightening device 80 further includes a mechanism adapted to bias the linking points 81 to 84, 91 to 94 in a direction of reversible tightening of the upper. This mechanism includes at least one lace strand, in this case two lace strands 96, 97. Of course, the strands run between the connection points or keepers 81 to 84, 91 to 94. The reversible tension of the strands is obtained by making a knot, by using a blocking device, or the like.

According to the invention, the envelope 11 is flexible, at least one connection point 81 to 83, 91 to 93 is located on a branch 21 to 26, 51 to 56, and at least one branch is adhesively bonded onto the envelope.

In fact, the branches 21 to 26, 51 to 56 enclose the envelope 11 in the area of the lace strands 96, 97 adapted to bias the connection points 81 to 83, 91 to 93 in a direction of reversible tightening of the upper. The branches transmit the tightening forces to the sole 2, which limits the biases of the envelope 11, at least in tension. The close contact created by the adhesive between the branches and the envelope 11 promotes a uniform application of the envelope 11 on the foot. Thus, undesirable movements of the foot in the shoe 1 are avoided, or at least substantially reduced. Moreover, the adhesive allows for a uniform application of a branch on the envelope over the entire surface of such branch, which would not be the case if the branch were stitched. As a result, there is a more uniform distribution of the pressures exerted by each branch on the envelope. Consequently, the risks of injuries related to an intensive or prolonged use are reduced, even non-existent.

Furthermore, the adhesive contributes more to stiffening the upper in the bonding zone of the branches.

According to the first embodiment, and in a non-limiting fashion, two successive branches from among branches 21 to 26 and 51 to 56 on respective ones of the sides 6 and 7, form an upper junction 101, 102, 103, 111, 112, 113 at their distal ends, the junction carrying a connection point. In other words, the same connection point 81 to 83, 91 to 93 is associated with two branches, which form an angle between them. This provides positional stability to the connection point and distributes the tightening stresses.

The shoe 1 therefore includes three lateral upper junctions 101, 102, 103, located at the intersection of the first 21 and second 22 lateral branches, at the intersection of the third 23 and fourth 24 branches, and at the intersection of the fifth 25 and sixth 26 branches, respectively. Similarly, the shoe 1 includes three medial upper junctions 111, 112, 113 located at the intersection of the first 51 and second 52 medial branches, at the intersection of the third 53 and fourth 54 branches, and at the intersection of the fifth 55 and sixth 56 branches, respectively. The lateral and medial junctions are located in the area of the instep. It is by distributing the tensions in this area that good foot support, i.e., stable support, is facilitated.

It is noted that two successive branches, which connect two distinct upper junctions 101 to 103 and 111 to 113, form a lower junction 121, 122 and 131, 132 at their proximal ends 32 to 35 and 62 to 65, respectively. More precisely, the shoe 1 includes two lateral lower junctions 121, 122, located at the intersection of the second 22 and third 23 lateral branches, and at the intersection of the fourth 24 and fifth 25 lateral branches, respectively. Similarly, the shoe 1 includes two medial lower junctions 131, 132, located at the intersection of the second 52 and third 53 medial branches, and at the intersection of the fourth 54 and fifth 55 medial branches, respectively. This zigzag shape of the branches facilitates a more uniform transfer of the tightening forces along the sole, in the area of the instep.

It is also provided, as shown in FIGS. 1 and 2, but in a non-limiting fashion, that a lateral branch, namely the sixth branch 26, extends continually from the instep to the heel 4, and that a medial branch, namely the sixth branch 56, also extends from the instep to the heel. This further increases the extent of the tightening action, and promotes the support of the heel of the foot in the heel 4 of the shoe. The other branches 21 to 25, 51 to 55 are located in the area of the instep.

In addition, the shoe 1 includes a lateral upper bridge 135, also adhesively bonded onto the envelope, which connects the lateral upper junctions 101, 102, 103 to one another, and a medial upper bridge 136, which connects the medial upper junctions 111, 112, 113 to one another. Each upper bridge 135, 136, supports forces that are exerted along the upper edges 47, 77, if necessary. These forces are generated from possible tightening unevenness at various connection points 81 to 84, 91 to 94.

The shoe 1 according to the first embodiment includes a lateral lower bridge 137, which is adhesively bonded along the envelope onto the edge of the sole, from the front to the rear, and which connects the lateral proximal ends 31 to 36 to one another, as well as a medial lower bridge 138, which connects the medial proximal ends 61 to 66 to one another. This constitutes an additional reinforcement that transversely retains the envelope 11, immediately in the area above the sole 2. Consequently, the foot is held better transversely, and the supports are more stable.

The branches 21 to 26, 51 to 56, and the bridges 135 to 138 are made out of a thin, flexible, and inextensible material. In other words, the reinforcement is made of a flexible and inextensible material. This makes it possible to closely conform to the shape of the envelope 11, to withstand a number of tightening forces, while making the upper 3 and, consequently, the shoe lighter.

It is provided, for example, that the branches and/or the bridges include a flexible synthetic band, the thickness of which is less than or equal to 1 mm. The branches and/or the bridges can even be provided to include a flexible synthetic band whose thickness is equal to or less than 0.3 mm. The weight reduction is even more substantial. The flexibility is even greater, which allows for a better contact between the upper 3 and the foot. In fact, the undesirable clearances are further reduced. The use of adhesive on all or a portion of the surface of the branches and of the bridges makes it possible to lighten their material.

By way of example, a size 42⅓ shoe, in European reference, weighs less than 340 g. In fact, at equal size, the shoe according to the invention enables a weight reduction equal to or greater than 5%.

The branches and the bridges have a width ranging between 5 and 20 mm. This enables a good distribution of pressures. The surface of the reinforcement 15 is less than 60% of the surface of the envelope and, for example, can be less than 35%.

All of the branches and bridges can be adhesively bonded onto the envelope 11. This produces a beautiful aesthetic effect, while eliminating the through stitches that can be awkward and require attaching additional fittings. The absence of stitches, or at least a very limited number of stitches, enables the envelope 11 to be applied more closely to the foot. The upper 3 is therefore more cohesive with the foot, in the manner of a second skin. The inner surface of the envelope of the upper is more uniform, and more continuous, compared to what it would be with stitches. This gives a feeling of lightness to the user.

Figure 3:
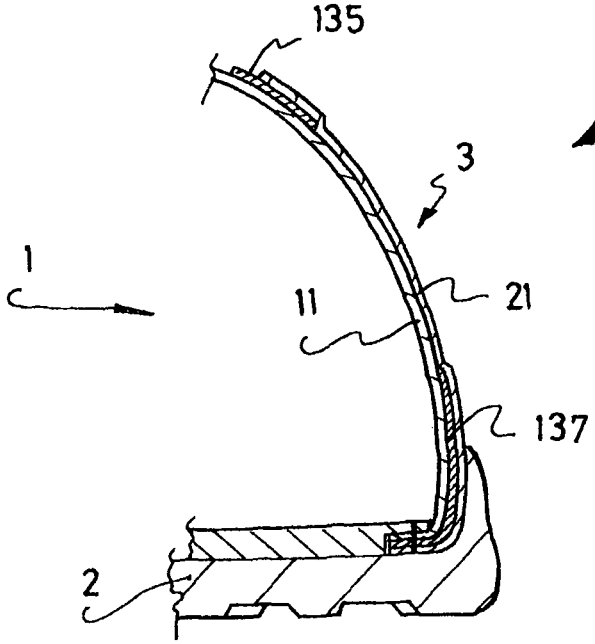
FIG. 3 is a cross section along the line III-III of FIG. 1.

With reference to FIG. 3, uniform contact is made between a branch 21, or a bridge 137, and the envelope 11. The absence of fitting inside the upper 3 improves tactile perception. The transmission of sensory information and impulses is perceived better. FIG. 3, a transverse cross section taken along lines III-III of FIG. 1, particularly in combination with FIG. 4, also represents that, at least at locations of the upper where the lower bridges 137, 138 are connected to lateral proximal ends of at least a successive pair of branches or, more specifically, a successive pair of lower junctions of branches, each of the lateral lower bridges is connected to the outsole 2.

Figure 4:
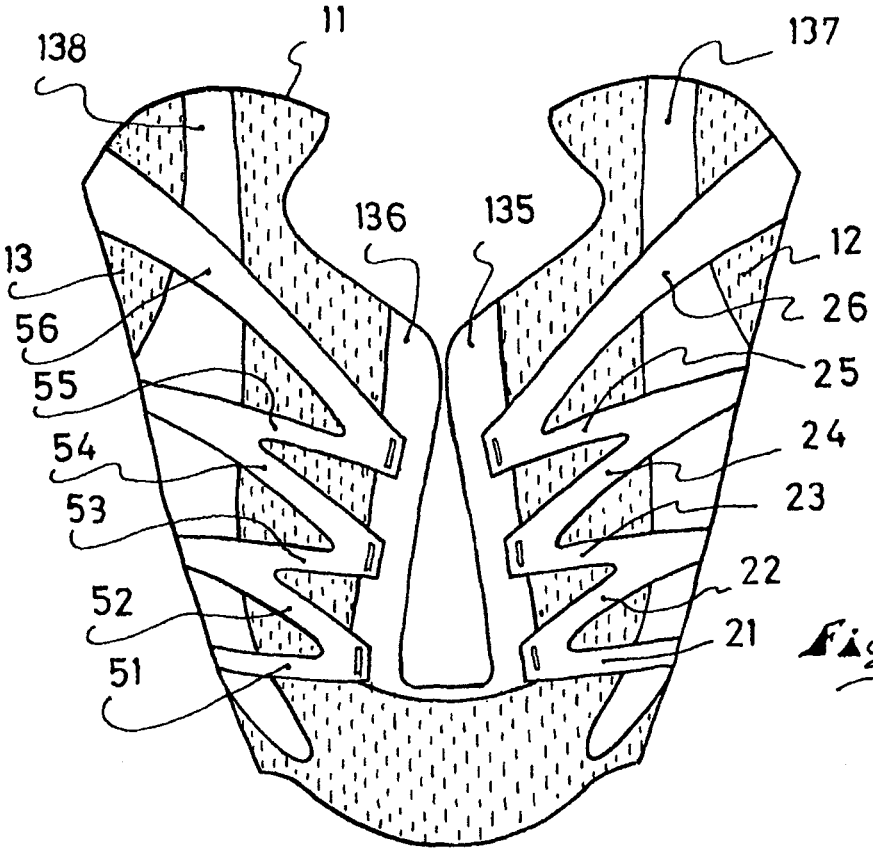
FIG. 4 is a top view of a pattern for the shoe upper according to the first embodiment.

In addition, FIG. 4 shows that the lateral quarter 12 and medial quarter 13 form a unitary element, i.e., a one-piece element. This makes it possible to envelop the foot evenly in the area of the toes, and facilitates the manufacture of the shoe 1. Indeed, the envelope 11 is initially created in the form of a flat element before shaping, i.e., before the element is set in place as part of the shoe. It is thus easier to bond the branches and the bridges with an adhesive, quite simply because it is faster and simpler to bond flat elements than raised elements.

Figure 5:
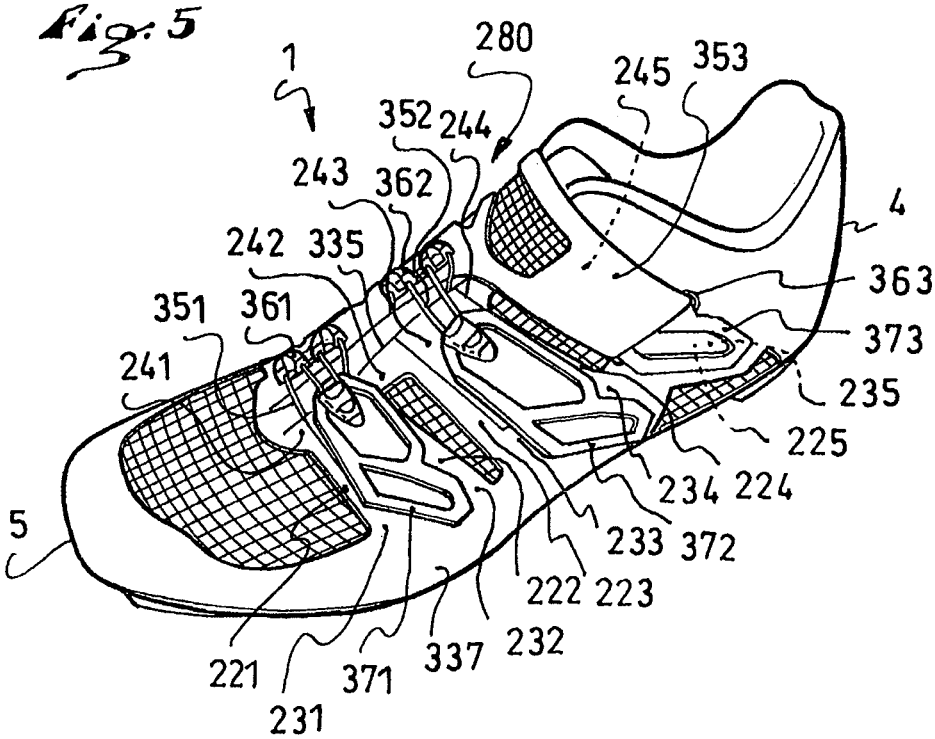
FIG. 5 is a perspective front view, lateral side, of a shoe according to a second embodiment of the invention.
Figure 6:
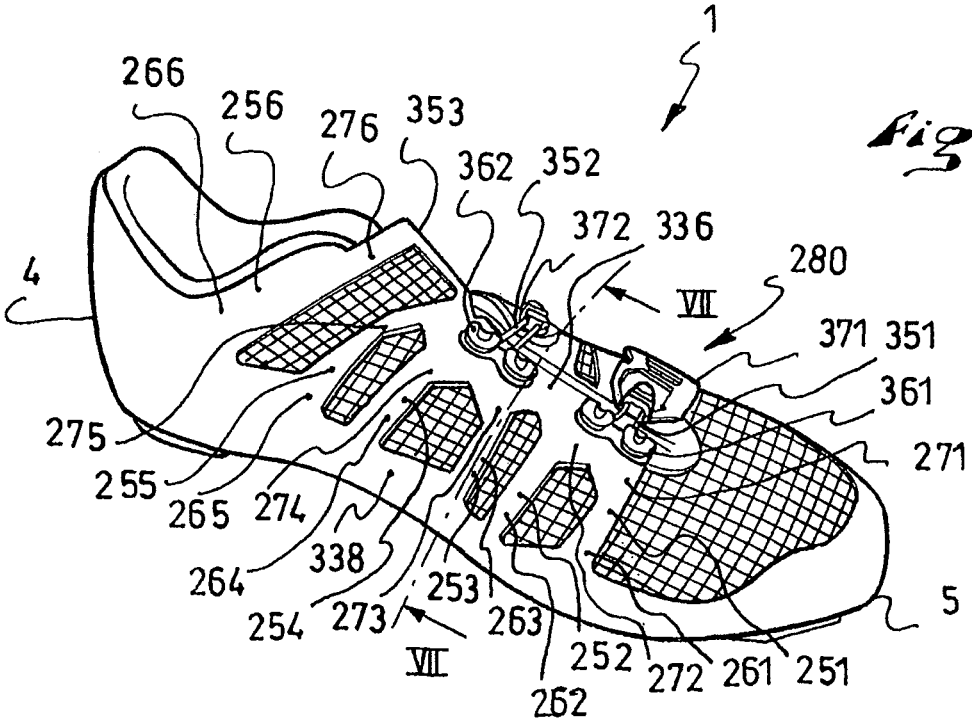
FIG. 6 is a perspective front view, medial side, of the shoe according to the second embodiment.
Figure 7:
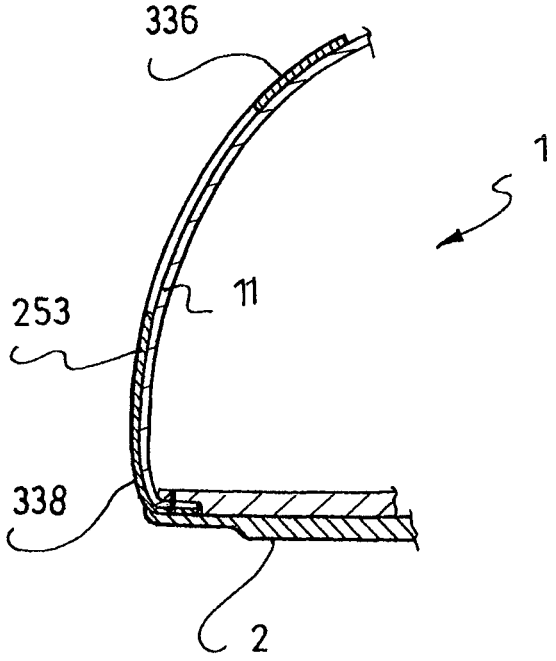
FIG. 7 is a cross section along the line VII-VII of FIG. 6.

The second embodiment is described hereinafter with reference to FIGS. 5 to 7. For reasons of convenience, the elements shared with the first embodiment are designated by the same reference numerals. Similarly, the structural and functional definitions are given or developed only if they differ from the first embodiment.

Thus, the shoe 1 according to the second embodiment includes a shoe 1 adapted for cycling. For this reason, the sole 2 is rigid. The upper 3 is made in the same spirit as for the first embodiment. One thus finds a heel 4, a front end 5, a lateral side 6 and a medial side 7. The envelope 11 includes a lateral quarter 12 and a medial quarter 13.

The second embodiment is specific in that it is the structure of the reinforcement 215 that covers the envelope 11. Here again, the reinforcement 215 includes lateral branches 221 to 225 and medial branches 251 to 256, a lateral upper bridge 335 that connects the lateral distal ends 241 to 245, as well as a medial upper bridge 336 that connects the medial distal ends 271 to 276. In fact, only the upper bridges 335, 336 connect the distal ends. In correlation, the branches of the reinforcement are directed along planes that are substantially perpendicular to the sole 2. This enables a better transmission of the pedaling forces, in particular when a leg pulls.

More precisely, the shoe 1 includes five lateral branches 221 to 225 and six medial branches 251 to 256. However, these numbers are not limiting. It is noted that a lateral branch 225 extends top down from the instep to the heel 4, that a medial branch 256 extends top down from the instep to the heel 4, and that the other branches 221 to 224, 251 to 255 extend from the sole to the top of the upper, in the area of the instep. This optimizes the distribution of the tightening and/or steering forces.

Again, the shoe 1 includes a lateral lower bridge 337 that extends along the sole and connects the lateral proximal ends 231 to 235, and a medial lower bridge 338 that extends along the sole and connects the medial proximal ends 261 to 266. This improves the distribution of the forces, as well as the transverse foot support. The lateral 337 and medial 338 lower bridges connect to one another towards the front end 5, in order to give a greater cohesion to the reinforcement 215, and thus to the upper 3.

According to the second embodiment, the connection points include linkages 351, 352, 353 secured to one of the upper bridges 335, 336, returns 361, 362, 363 secured to the other upper bridge or to a linkage, and the mechanism provided to bias the connection points include devices 371, 372, 373 for reversibly tensioning the linkages. In fact, this is well-known to one of ordinary skill in the art. In a non-limiting fashion, the linkages include a band 353 and at least one lace strand 351, 352. The tensioning devices 371, 372, 373 include complementary flexible layers, some of which are provided with loops, and the others with hooks for attachment.

In any case, the invention is embodied from materials and according to implementation techniques known to one ordinary skill in the art.

The invention is not limited to the embodiments described hereinabove, and includes all of the technical equivalents that fall within the scope of the claims that follow.

The invention is not limited to the embodiments described hereinabove, and includes all of the technical equivalents that fall within the scope of the claims that follow.

In particular, the number of branches can vary. Certain branches may not be adhesively bonded.

Also, substantially all of the technical features of the first embodiment are applicable to the second embodiment.

The materials used to manufacture the reinforcement 15, 215, i.e., the branches and the bridges, include, for example, a film of polyurethane, or any equivalent. The adhesive that associates the reinforcement with the envelope also includes polyurethane. An adhesive film can be preliminarily applied to the reinforcement.

The invention claimed is:

1. An article of footwear comprising:

an outsole;

an upper having a lateral side, a medial side, a front end, and a rear end;

a tightening device for reversibly tightening the upper at least relative to the foot of a wearer;

the upper including an envelope and a reinforcement at least partially covering the envelope;

the reinforcement including a plurality of lateral branches and a plurality of medial branches;

each branch of said plurality of lateral branches and said plurality of medial branches extending transversely from a proximal end located in the area of the outsole to a distal end;

the tightening device comprising:

a plurality of lateral connection points and a plurality of medial connection points, each of the lateral and medial branches being secured to the upper; and a mechanism structured and arranged to bias a plurality of the connection points in a direction for reversible tightening the upper;

the envelope comprising a flexible material, the plurality of connection points being located on respective ones of the plurality of lateral and medial branches of the reinforcement, and the respective ones of the plurality of lateral and medial branches being adhesively bonded on the envelope on at least portions of respective lengths of the plurality of lateral and medial branches;

on at least one of the medial and lateral sides of the upper:

a first pair of successive branches of the plurality of branches of the reinforcement form a first upper junction at respective distal ends of the first pair of successive branches, the first upper junction carrying a first of the plurality of connection points; and a second pair of successive branches of the plurality of branches of the reinforcement form a second upper junction at respective distal ends of the second pair of successive branches, the second upper junction carrying a second of the plurality of connection points;

an upper bridge connecting the first and second upper junctions to one another, the upper bridge comprising a flexible and inextensible material.

2. An article of footwear according to claim 1, wherein:

the upper comprises three lateral upper junctions and three medial upper junctions, the lateral and medial junctions being located in an instep area of the upper.

3. An article of footwear according to claim 1, wherein:

two successive branches, connecting two distinct upper junctions, form a lower junction at proximal ends of said two successive branches.

4. An article of footwear according to claim 1, wherein:

the plurality of lateral branches comprises a lateral branch extending continually from an instep to a heel of the article of footwear;

the plurality of medial branches comprises a medial branch extending continually from an instep to a heel of the article of footwear; and other branches of the pluralities of lateral and medial branches are located in an area of the instep.

5. An article of footwear according to claim 1, wherein:

the first and second pair of successive branches on at least one of the medial and lateral sides of the upper are on the medial side of the upper;

on the lateral side of the upper:

a first pair of successive lateral branches of the plurality of branches of the reinforcement form a first lateral upper junction at respective distal ends of the first pair of successive lateral branches, the first lateral upper junction carrying a first of the plurality of lateral connection points; and a second pair of successive lateral branches of the plurality of branches of the reinforcement form a second lateral upper junction at respective distal ends of the second pair of successive lateral branches, the second upper lateral junction carrying a second of the plurality of lateral connection points;

an upper lateral bridge connecting the first and second lateral upper junctions to one another, the upper lateral bridge comprising a flexible and inextensible material.

6. An article of footwear according to claim 1, further comprising:

a lateral lower bridge connecting the lateral proximal ends of each of the plurality of lateral branches to one another;

a medial lower bridge connecting the medial proximal ends of each of the plurality of medial branches to one another.

7. An article of footwear according to claim 6, wherein:

each of the medial and lateral lower bridges comprises a flexible and inextensible material.

8. An article of footwear according to claim 6, wherein:

at least at locations of the upper where the lateral lower bridge is connected to lateral proximal ends of at least a successive pair of the plurality of the lateral branches, the lateral lower bridge is connected to the outsole;

at least at locations of the upper where the medial lower bridge is connected to medial proximal ends of at least a successive pair of the plurality of the medial branches, the medial lower bridge is connected to the outsole.

9. An article of footwear according to claim 1, wherein:

the connection points comprise keepers;

the mechanism structured and arranged to bias the connection points includes at least one lace strand.

10. An article of footwear according to claim 9, wherein:

the keepers are fixed to the upper and to the reinforcement.

11. An article of footwear according to claim 1, wherein:

the envelope includes an a-jour fabric;

an entirety of the reinforcement is made out of flexible and inextensible material.

12. An article of footwear according to claim 1, wherein:

the branches and/or the bridges include a flexible synthetic band having a thickness of less than or equal to 1 mm.

13. An article of footwear according to claim 1, wherein:

the branches and/or the bridges include a flexible synthetic band having a thickness of less than or equal to 0.3 mm.

14. An article of footwear according to claim 1, wherein:

the envelope includes a lateral quarter and a medial quarter, said lateral and medial quarters forming a unitary element.

15. An article of footwear according to claim 1, wherein:

the outsole is flexible.

16. An article of footwear according to claim 1, wherein:

all of the branches and the bridges are adhesively bonded on the envelope.

17. An article of footwear according to claim 1, wherein:

the reinforcement has an entire surface area less than 60% of an entire surface area of the envelope.

18. An article of footwear according to claim 1, wherein:

the reinforcement has an entire surface area less than 35% of an entire surface area of the envelope.

19. A method of manufacturing an article of footwear, the article of footwear comprising:

an external outsole;

an upper having a lateral side, a medial side, a front end, and a rear end;

a tightening device for reversibly tightening the upper at least relative to the foot of a wearer;

the upper including an envelope and a reinforcement at least partially covering the envelope;

the reinforcement including a plurality of lateral branches and a plurality of medial branches;

each branch of said plurality of lateral branches and said plurality of medial branches extending transversely from a proximal end located in the area of the outsole to a distal end;

the tightening device comprising:

a plurality of lateral connection points and a plurality of medial connection points, each of the lateral and medial branches being secured to the upper; and a mechanism structured and arranged to bias a plurality of the connection points in a direction for reversible tightening the upper;

the envelope comprising a flexible material, the plurality of connection points being located on respective ones of the plurality of lateral and medial branches of the reinforcement, and the respective ones of the plurality of lateral and medial branches being adhesively bonded on the envelope on at least portions of respective lengths of the plurality of lateral and medial branches;

on at least one of the medial and lateral sides of the upper:

a first pair of successive branches of the plurality of branches of the reinforcement form a first upper junction at respective distal ends of the first pair of successive branches, the first upper junction carrying a first of the plurality of connection points; and a second pair of successive branches of the plurality of branches of the reinforcement form a second upper junction at respective distal ends of the second pair of successive branches, the second upper junction carrying a second of the plurality of connection points;

an upper bridge connecting the first and second upper junctions to one another, the upper bridge comprising a flexible and inextensible material;

said method comprising:

before setting in place the upper in relation to the outsole, assembling parts of the upper together;

the assembling parts of the upper together comprising:

positioning the envelope to be a flat envelope;

adhesively bonding to the flat envelope the following: the respective ones of the plurality of lateral and medial branches and the upper bridge.

20. The method of claim 19, wherein:

the article of footwear further comprises a lateral lower bridge connecting the lateral proximal ends to one another and a medial lower bridge connecting the medial proximal ends to one another; and said method further comprises adhesively bonding lateral and medial bridges to the flat envelope.

* * * * *